US009845580B2

(12) United States Patent
Utterodt et al.

(10) Patent No.: US 9,845,580 B2
(45) Date of Patent: Dec. 19, 2017

(54) COMPACTION SYSTEM INCLUDING ARTICULATED JOINT FORCE MEASUREMENT

(71) Applicant: Caterpillar Paving Products Inc., Minneapolis, MN (US)

(72) Inventors: Ronald Utterodt, Lutten (DE); Thomas Frelich, Albertville, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 54 days.

(21) Appl. No.: 15/138,148

(22) Filed: Apr. 25, 2016

(65) Prior Publication Data

US 2017/0306575 A1 Oct. 26, 2017

(51) Int. Cl.

| | |
|---|---|
| ***E01C 19/00*** | (2006.01) |
| ***E01C 19/28*** | (2006.01) |
| ***E02D 3/026*** | (2006.01) |
| ***E01C 19/26*** | (2006.01) |

(52) U.S. Cl.

CPC ..... *E01C 19/288* (2013.01); *E01C 19/26* (2013.01); *E01C 19/282* (2013.01); *E02D 3/026* (2013.01); *E02D 2600/10* (2013.01)

(58) Field of Classification Search

CPC ..... E01C 19/26; E01C 19/282; E01C 19/288; E02D 2600/10

USPC ..... 404/75, 84.05, 117, 122–126; 701/50

See application file for complete search history.

(56) References Cited

U.S. PATENT DOCUMENTS

| | | | | |
|---|---|---|---|---|
| 3,244,249 | A * | 4/1966 | Thomas | B62D 53/021 180/14.4 |
| 3,814,531 | A * | 6/1974 | Carnahan | E01C 19/283 180/420 |
| 3,844,671 | A * | 10/1974 | Domenighetti | B62D 53/02 180/12 |
| 6,188,942 | B1 | 2/2001 | Corcoran et al. | |
| 6,973,821 | B2 | 12/2005 | Corcoran | |
| 7,226,239 | B2 | 6/2007 | Stridiron et al. | |
| 7,845,878 | B1 | 12/2010 | Godbersen et al. | |
| 8,671,760 | B2 | 3/2014 | Wallrath et al. | |
| 9,207,157 | B2 * | 12/2015 | Frelich | G01P 3/00 |
| 9,389,156 | B2 * | 7/2016 | Anderegg | E01C 19/282 |
| 2009/0143952 | A1 | 6/2009 | Chisholm et al. | |
| 2011/0229264 | A1 * | 9/2011 | Weiser | E01C 19/48 404/72 |
| 2012/0045281 | A1 * | 2/2012 | Wagner | B62D 12/00 404/117 |

* cited by examiner

*Primary Examiner* — Raymond W Addie

(57) ABSTRACT

A compaction system includes a first frame; a second frame coupled to the first frame via an articulated joint; a first propulsion device operatively coupled to the first frame via a first propulsion motor, the first propulsion device being configured to propel the compaction system over a work surface in response to a power applied by the first propulsion motor; a compaction drum operatively coupled to the second frame, the compaction drum being configured to compact the work surface via rolling engagement with the work surface; a force sensor configured and arranged to generate a signal that is indicative of a propulsion force transmitted through the articulated joint; and a controller operatively coupled to the force sensor. The controller is configured to determine compaction performance of the compaction system against the work surface based at least in part on the signal from the force sensor.

20 Claims, 6 Drawing Sheets

COMPACTION SYSTEM INCLUDING ARTICULATED JOINT FORCE MEASUREMENT

TECHNICAL FIELD

The present disclosure relates generally to compaction systems and, more particularly, to a surface material compaction system including force measurement through an articulated joint and a controller configured to determine compaction performance of the compaction system based at least in part on the measured articulated joint force.

BACKGROUND

Compaction systems and machines incorporating compaction systems are known for compacting surface materials to increase a density or a stiffness of the surface material. Examples of applications where surface compaction is desired include construction sites to avoid further natural settling of the ground, landfill sites where compaction of the landfill waste into a minimum volume is desired, and asphalt roads and parking lots to avoid further settling of the asphalt, and therefore avoid future cracking of the road or parking lot.

The amount of compaction of these materials may be monitored to determine when the material is compressed to a desired density or stiffness. And in the past, various methods for determining an amount of compaction have been employed. For example, direct measurements of material density may be performed at either random or predetermined locations. The measurements may be made by removing core samples of the material for density measurements, or by sand or water displacement devices. Alternatively, the measurements may be made by some means which does not disturb the material, such as by nuclear gauges, electromagnetic measurement devices, and the like.

The above-noted methods for determining the density or stiffness of the material being compacted only provide indications of density at the sample locations chosen for testing. In addition, the above-noted methods require additional time and work by the persons performing the tests, which may increase costs and reduce efficiency of the compaction process. Furthermore, the methods discussed above which disturb portions of the compacted area are not desirable in some situations, for example, when compacting blacktop in a parking lot, as the disturbance of the surface material may adversely affect the finished product.

U.S. Pat. No. 6,973,821 ("the '821 patent"), entitled "Compaction Quality Assurance Based Upon Quantifying Compactor Interaction with Base Material," describes effective apparatus and methods for on-board determination of compaction quality based upon a sinkage deformation interaction between the compactor and the base material. One strategy described by the '821 patent includes monitoring an energy interaction between the compactor and the base material. The '821 patent further states that propelling power corresponds to the compactive energy delivered by the compactor to the base material, and may be used as a basis for monitoring the above-noted energy interaction.

However, the apparatus and methods described in the '821 patent may benefit from new apparatus and methods to further reduce uncertainty and to promote accuracy of the on-board determination of compaction quality. Accordingly, aspects of the present disclosure address the above-noted opportunities for improvement in the determination of compaction quality and/or other challenges in the art.

It will be appreciated that this background description has been created to aid the reader, and is not a concession that any of the indicated problems were themselves known previously in the art.

SUMMARY

According to an aspect of the disclosure, a compaction system comprises a first frame; a second frame coupled to the first frame via an articulated joint; a first propulsion device operatively coupled to the first frame via a first propulsion motor, the first propulsion device being configured to propel the compaction system over a work surface in response to a power applied by the first propulsion motor; a compaction drum operatively coupled to the second frame, the compaction drum being configured to compact the work surface via rolling engagement with the work surface; a force sensor configured and arranged to generate a signal that is indicative of a propulsion force transferred through the articulated joint; and a controller operatively coupled to the force sensor. The controller is configured to determine compaction performance of the compaction system against the work surface based at least in part on the signal from the force sensor.

Another aspect of the disclosure provides a method for compacting a work surface with a compaction system. The compaction system includes a first propulsion device operatively coupled to a compaction drum via an articulated joint, a force sensor configured and arranged to generate a signal indicative of a propulsion force transferred from the first propulsion device to the compaction drum via the articulated joint, and a controller operatively coupled to the force sensor. The method comprises propelling the compaction system over the work surface by applying a propulsion power to a first propulsion device in contact with the work surface; compacting the work surface in response to the propelling the compaction system over the work surface; and determining via the controller a first compaction performance of the compaction system against the work surface based at least in part on the signal from the force sensor.

According to another aspect of the disclosure, a machine for compacting a work surface comprises a first frame; a second frame coupled to the first frame via an articulated joint; a first propulsion device operatively coupled to the first frame via a first propulsion motor, the first propulsion device being configured to propel the machine over a work surface in response to a power applied by the first propulsion motor; a compaction drum operatively coupled to the second frame, the compaction drum being configured to compact the work surface via rolling engagement with the work surface; a force sensor configured and arranged to generate a signal that is indicative of a propulsion force transferred through the articulated joint; and a controller operatively coupled to the force sensor. The controller is configured to determine compaction performance of the machine the work surface based at least in part on the signal from the force sensor.

DETAILED DESCRIPTION

Aspects of the disclosure will now be described in detail with reference to the drawings, wherein like reference numbers refer to like elements throughout, unless specified otherwise.

Figure 1:
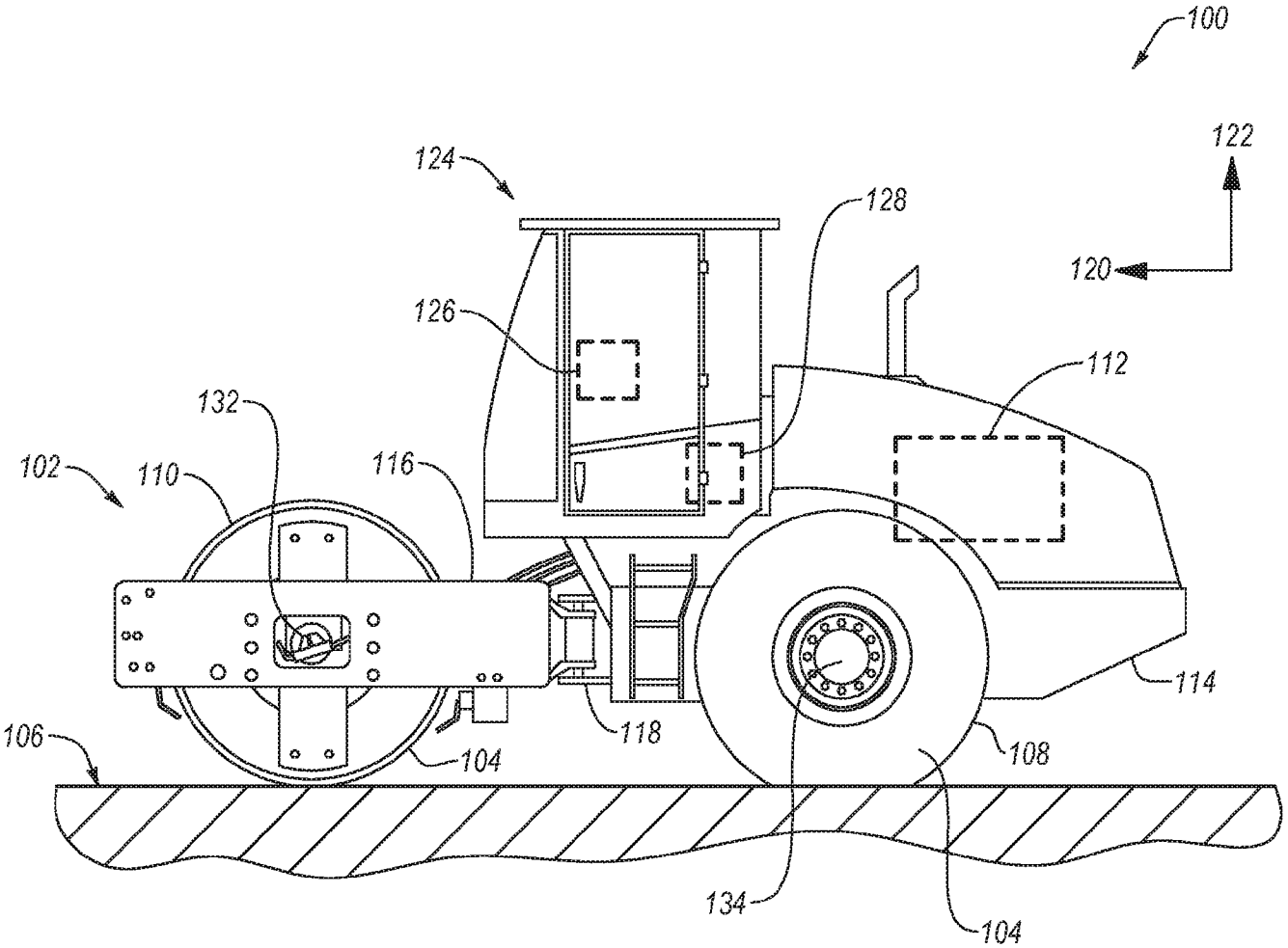
FIG. 1 is a side view of a compactor machine including a compaction system, according to an aspect of the disclosure.

FIG. 1 is a side view of a compactor machine 100 including a compaction system 102, according to an aspect of the disclosure. The compactor machine 100 may be configured in a variety of ways to perform a variety of compaction operations. For example, aspects of the present disclosure find application to landfill compactors that may be configured with tipped rollers for compacting landfill waste, paving compactors that may be designed with smooth rollers to compact asphalt for roads or parking lots, and other compactors that may be configured for compacting soil or to otherwise prepare earthworks.

The compaction system 102 includes one or more rolling elements 104 that are configured to compact a work surface 106 through rolling engagement with the work surface 106. The work surface 106 may include soil, gravel, landfill waste, asphalt, combinations thereof, or any other surface material known in the art to benefit from a compaction process.

The one or more rolling elements 104 may include a propulsion device 108, a compaction drum 110, or combinations thereof. The propulsion device 108 is operatively coupled to a mechanical power source 112 for transfer of mechanical power from the mechanical power source 112 to the propulsion device 108 to propel the compactor machine 100 over the work surface 106. The propulsion device 108 may include one or more pneumatic tires, a compaction drum, a track drive, a belt drive, or any other land-based propulsion device known in the art.

The compaction drum 110 may be optionally or selectively coupled to the mechanical power source 112 to transfer mechanical power from the mechanical power source 112 to the compaction drum 110 to propel the compaction drum 110 over the work surface 106, drive a compaction mechanism 130 (see FIGS. 2 and 4) within the compaction drum 110, or combinations thereof. A compaction mechanism 130 of the compaction drum 110 may include a vibratory compaction mechanism. A circumferential surface of the compaction drum 110 may be a smooth surface, a textured surface, such as that on a tipped drum, or any other compaction drum surface structure known in the art.

The mechanical power source 112 may include a reciprocating piston internal combustion engine, a gas turbine, an electric motor, or any other prime mover known in the art. The operative coupling between the mechanical power source 112 and the propulsion device 108 or the compaction drum 110 may include a geared transmission, a belt and pulley drive, an electric generator-motor drive, a hydraulic pump-motor fluid coupling, combinations thereof, or any other mechanical power transmission known in the art.

The compactor machine 100 may include a first frame 114 coupled to a second frame 116 via an articulated joint 118. The articulated joint 118 is configured to enable a rotational degree of freedom between the first frame 114 and the second frame 116 about an axis that extends at least partly along a vertical direction 122, and to transmit propulsion force between the first frame 114 and the second frame 116 along a longitudinal direction 120. The longitudinal direction 120 of the compactor machine 100 may extend at least partly from the first frame 114 toward the second frame 116, and a height or vertical direction 122 of the compactor machine 100 may extend transverse to the longitudinal direction 120 from the work surface 106 toward the compactor machine 100.

In some applications, the portion of the compactor machine 100 disposed aft or rearward of the articulated joint 118, along the longitudinal direction 120, may be referred to as the trolley. The trolley may include, the first frame 114, the cab 124, the mechanical power source 112, and the one or more propulsion devices 108, for example.

As shown in the non-limiting aspect illustrated in FIG. 1, the propulsion device 108 is coupled to the first frame 114 via a rotational bearing 134, and the compaction drum 110 is coupled to the second frame via a rotational bearing 132. However, it will be appreciated that other configurations for the compactor machine are contemplated to fall within the scope of the present disclosure, including, but not limited to, towed compaction drums. The propulsion device 108 may rotate on a first axle that is centered on a first axis of rotation, and the compaction drum 110 may rotate around a second axle that is centered on a second axis of rotation.

The compactor machine 100 may include a cab 124 configured to accommodate an operator of the compactor machine 100. The cab may include a seat and one or more control devices 126. The one or more control devices 126 may include a steering mechanism, a speed/throttle input, a console, a data display, a network telemetry link, combinations thereof, or any other input or output device known in the art to benefit operation of the compactor machine 100. The one or more control devices 126 may be operatively coupled to a controller 128 for transmission of control inputs, machine state feedback, environmental state feedback, or any other control signals therebetween.

Figure 2:
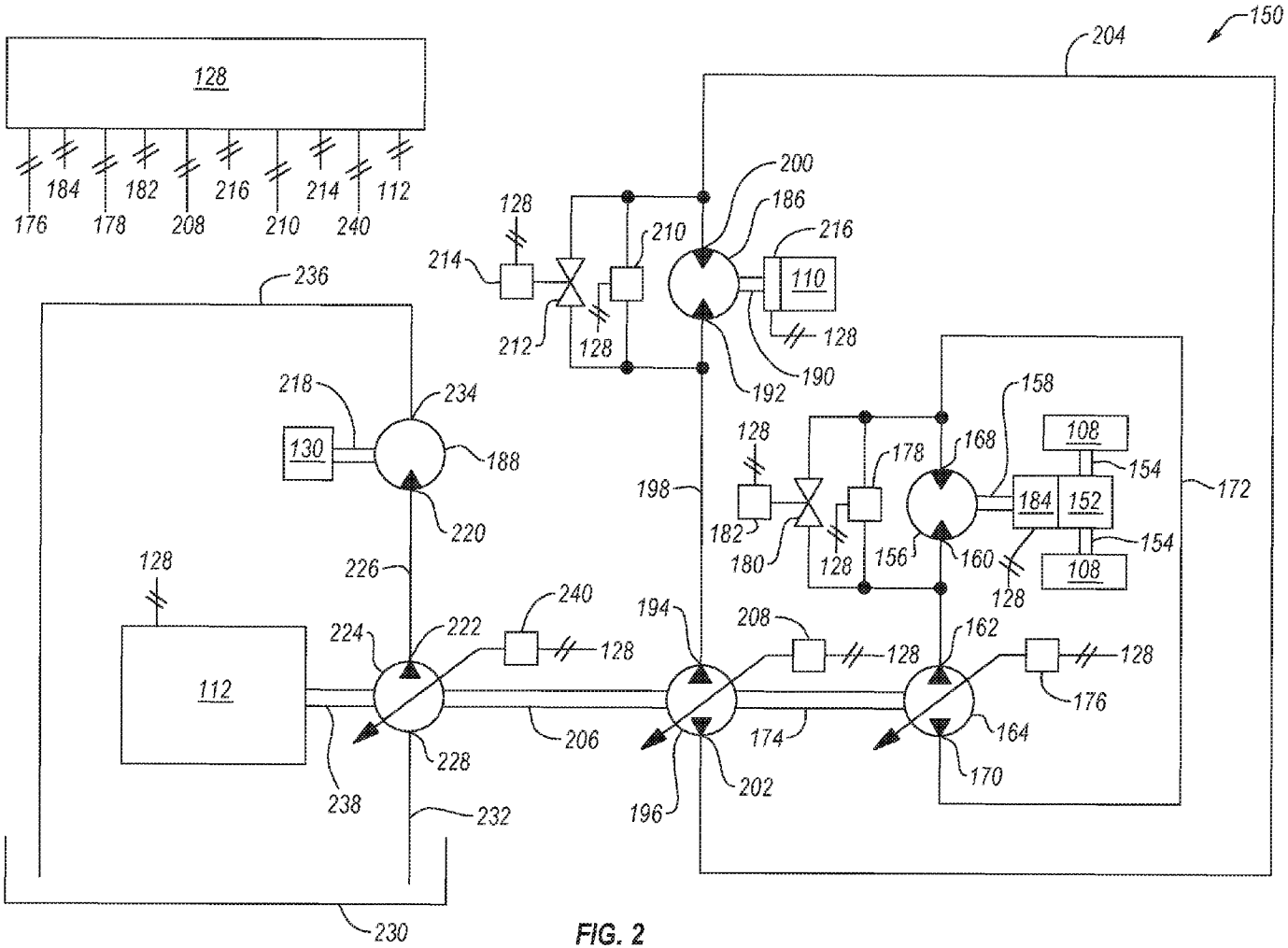
FIG. 2 is a schematic view of a power train for a compaction system, according to an aspect of the disclosure.

FIG. 2 is a schematic view of a power train 150 for a compaction system 102, according to an aspect of the disclosure. The power train 150 includes the mechanical power source 112 and mechanical couplings between the mechanical power source 112 and the at least one propulsion device 108, the compaction drum 110, the compaction mechanism 130, or combinations thereof, for transmission of mechanical power therebetween. Although FIG. 2 shows a power train 150 with predominately hydraulic-based transmission of mechanical power, it will be appreciated that the power train 150 may include any other means for transmitting mechanical power known in the art, including, but not limited to, geared transmissions, belt and pulley transmissions, electric motor-generator transmissions, and combinations thereof.

The at least one propulsion device 108 may be operatively coupled to a differential gear assembly 152 via an axle shaft 154 for transmission of mechanical power therebetween.

According to an aspect of the disclosure, the at least one propulsion device 108 includes two wheels, where each wheel is operatively coupled to the differential gear assembly 152 by a respective axle shaft 154 for transmission of mechanical power therebetween. Pneumatic tires may be mounted to each of the two wheels.

The differential gear assembly 152 may be operatively coupled to a first propulsion motor 156 via a shaft 158 for transmission of mechanical power therebetween. The first propulsion motor 156 may be configured as a bi-directional hydraulic motor with a fixed displacement; however, it will be appreciated that the first propulsion motor 156 may embody other configurations to meet application requirements.

A first port 160 of the first propulsion motor 156 may be fluidly coupled to a first port 162 of a first propulsion pump 164 via the conduit 166, for transmission of hydraulic power therebetween; and a second port 168 of the first propulsion motor 156 may be fluidly coupled to a second port 170 of the first propulsion pump 164 via the conduit 172, for transmission of hydraulic power therebetween. The first propulsion pump 164 may be configured as a bi-directional flow pump with a variable displacement, however, it will be appreciated that the first propulsion pump 164 may embody other configurations to meet application requirements. Further, the first propulsion pump 164 may be operatively coupled to the mechanical power source 112 via a shaft 174, for transmission of mechanical power therebetween.

Accordingly, the first propulsion motor 156, the first propulsion pump 164, and the conduits 166, 172 may compose a closed-loop, hydrostatic drive circuit for transmitting mechanical power from the mechanical power source 112 to the propulsion devices 108. When configured in a first flow direction, the first port 162 is an outlet port of the first propulsion pump 164, and the first port 160 is an inlet port of the first propulsion motor 156. And in the first configuration, flow from the first port 162 of the first propulsion pump 164 to the first port 160 of the first propulsion motor 156 causes the shaft 158 and the propulsion devices 108 to rotate in a first direction, respectively.

When configured in a second flow direction, which is opposite the first flow direction, the second port 170 is an outlet port of the first propulsion pump 164, and the second port 168 is an inlet port of the first propulsion motor 156. And in the second configuration, flow from the second port 170 of the first propulsion pump 164 to the second port 168 of the first propulsion motor 156 causes the shaft 158 and the propulsion devices 108 to rotate in a second direction, respectively, that is opposite the first direction. Accordingly, the first configuration of the first propulsion pump 164 may propel the compactor machine 100 forward along the longitudinal direction 120, and the second configuration of the first propulsion pump 164 may propel the compactor machine 100 backward along the longitudinal direction 120.

The first propulsion pump 164 may be operatively coupled to an actuator 176 that is configured to adjust a flow direction through the first propulsion pump 164, displacement of the first propulsion pump 164, or combinations thereof. The actuator 176 may be a swash plate actuator or any other hydraulic pump actuator known in the art. Further, the actuator 176 may be operatively coupled to the controller 128, such that the controller 128 may adjust a flow direction through the first propulsion pump 164, displacement of the first propulsion pump 164, or combinations thereof via the actuator 176. It will be appreciated that adjusting the displacement of the first propulsion pump 164 via the actuator 176 may be used to vary a travel speed of a compactor machine 100 incorporating the power train 150 by varying a hydraulic flow rate through the first propulsion motor 156.

A pressure sensor 178 may be fluidly coupled to the conduit 166, the conduit 172, or both, and be configured for generating a signal that is indicative of a pressure potential driving the first propulsion motor 156. According to an aspect of the disclosure, the pressure sensor 178 is a differential pressure sensor that is configured and arranged to measure a pressure drop across the first propulsion motor 156. Further, the pressure sensor 178 may be operatively coupled to the controller 128 for transmitting the pressure signal from the pressure sensor 178 to the controller 128.

The power train 150 may optionally include a first bypass valve 180 that is configured to bypass hydraulic fluid around the first propulsion motor 156, the first propulsion pump 164, or both. Accordingly, when the first bypass valve 180 is configured in an open position, the first propulsion motor 156 and the propulsion devices 108 may be placed in a neutral configuration, such that the first propulsion motor 156 and the propulsion devices 108 may rotate freely and independent of the operation of the first propulsion pump 164.

The first bypass valve 180 may be operatively coupled to an actuator 182, and the actuator 182 may be operatively coupled to the controller 128. Accordingly, the controller 128 may actuate the first bypass valve 180 via the actuator 182.

The power train 150 may optionally include a first clutch 184 that is configured and arranged to effect selective mechanical coupling or uncoupling between the first propulsion motor 156 and the propulsion devices 108. The first clutch 184 may be operatively coupled to the controller 128, such that the controller 128 may selectively cause the first clutch 184 to mechanically couple or uncouple the first propulsion motor 156 and the propulsion devices 108. Although the first clutch 184 is shown disposed in series between the shaft 158 and the differential gear assembly 152 in FIG. 2, it will be appreciated that the first clutch 184 may be disposed anywhere along a power transmission path between the first propulsion motor 156 and the propulsion devices 108.

Referring still to FIG. 2, the compaction drum 110 may include two mechanical power inputs, namely a mechanical power input for transmitting propulsion power to the compaction drum 110, which causes the compaction drum 110 to rotate relative to the second frame 116, for example, and a mechanical power input for transmitting power to a compaction mechanism 130. The compaction mechanism 130 of the compaction drum 110 may include a vibratory compaction mechanism, that is capable of varying an amplitude, a frequency, or both, of a periodic compaction force applied to the work surface 106 via the compaction drum 110. According to an aspect of the disclosure, a second propulsion motor 186 provides mechanical power to propel the compaction drum 110 in rolling engagement with the work surface 106, and a compaction motor 188 provides mechanical power to the compaction mechanism 130.

The compaction drum 110 may be operatively coupled to the second propulsion motor 186 via a shaft 190 for transmission of mechanical power therebetween. The second propulsion motor 186 may be configured as a bi-directional hydraulic motor with a fixed displacement; however, it will be appreciated that the second propulsion motor 186 may embody other configurations to meet application requirements.

A first port 192 of the second propulsion motor 186 may be fluidly coupled to a first port 194 of a second propulsion pump 196 via the conduit 198, for transmission of hydraulic power therebetween; and a second port 200 of the second propulsion motor 186 maybe fluidly coupled to a second port 202 of the second propulsion pump 196 via the conduit 204, for transmission of hydraulic power therebetween. The second propulsion pump 196 may be configured as a bi-directional flow pump with a variable displacement; however, it will be appreciated that the second propulsion pump 196 may embody other configurations to meet application requirements. Further, the second propulsion pump 196 may be operatively coupled to the mechanical power source 112 via a shaft 206, for transmission of mechanical power therebetween.

Accordingly, the second propulsion motor 186, the second propulsion pump 196, and the conduits 198, 204 may compose a closed-loop, hydrostatic drive circuit for transmitting propulsion power from the mechanical power source 112 to the compaction drum 110. When configured in a first flow direction, the first port 194 is an outlet port of the second propulsion pump 196, and the first port 192 is an inlet port of the second propulsion motor 186. And in the first configuration, flow from the first port 194 of the second propulsion pump 196 to the first port 192 of the second propulsion motor 186 causes the shaft 190 and the compaction drum 110 to rotate in a first direction, respectively.

When configured in a second flow direction, which is opposite the first flow direction, the second port 202 is an outlet port of the second propulsion pump 196, and the second port 200 is an inlet port of the second propulsion motor 186. And in the second configuration, flow from the second port 202 of the second propulsion pump 196 to the second port 200 of the second propulsion motor 186 causes the shaft 190 and the propulsion devices 108 to rotate in a second direction, respectively, that is opposite the first direction. Accordingly, the first configuration of the second propulsion pump 196 may propel the compaction drum 110 forward along the longitudinal direction 120, and the second configuration of the second propulsion pump 196 may propel the compaction drum backward along the longitudinal direction.

The second propulsion pump 196 may be operatively coupled to an actuator 208 that is configured to adjust a flow direction through the second propulsion pump 196, displacement of the second propulsion pump 196, or combinations thereof. The actuator 208 may be a swash plate actuator or any other hydraulic pump actuator known in the art. Further, the actuator 208 may be operatively coupled to the controller 128, such that the controller 128 may adjust a flow direction through the second propulsion pump 196, a displacement of the second propulsion pump 196, or combinations thereof, via the actuator 208. It will be appreciated that adjusting the displacement of the second propulsion pump 196 via the actuator 208 may be used to vary a travel speed of a compactor machine 100 incorporating the power train 150 by varying a hydraulic flow rate through the second propulsion motor 186.

A pressure sensor 210 may be fluidly coupled to the conduit 198, the conduit 204, or both, and be configured for generating a signal that is indicative of a pressure potential driving the second propulsion motor 186. According to an aspect of the disclosure, the pressure sensor 210 is a differential pressure sensor that is configured and arranged to measure a pressure drop across the second propulsion motor 186. Further, the pressure sensor 210 may be operatively coupled to the controller 128 for transmitting the pressure signal from the pressure sensor 210 to the controller 128.

The power train 150 may optionally include a second bypass valve 212 that is configured to bypass hydraulic fluid around the second propulsion motor 186, the second propulsion pump 196, or both. Accordingly, when the second bypass valve 212 is configured in an open position, the second propulsion motor 186 and the compaction drum 110 may be placed in a neutral configuration, such that the second propulsion motor 186 and the compaction drum 110 may rotate freely and independent of the operation of the second propulsion pump 196.

The second bypass valve 212 may be operatively coupled to an actuator 214, and the actuator 214 may be operatively coupled to the controller 128. Accordingly, the controller 128 may actuate the second bypass valve 212 via the actuator 214.

The power train 150 may optionally include a second clutch 216 that is configured and arranged to effect selective mechanical coupling or uncoupling between the second propulsion motor 186 and the compaction drum 110. The second clutch 216 may be operatively coupled to the controller 128, such that the controller 128 may selectively cause the second clutch 216 to mechanically couple or uncouple the second propulsion motor 186 and the compaction drum 110.

Referring still to FIG. 2, the compaction mechanism 130 may be operatively coupled to the compaction motor 188 via a shaft 218 for transmission of mechanical power therebetween. An inlet port 220 of the compaction motor 188 may be fluidly coupled to an outlet port 222 of a compaction pump 224 via a conduit 226, for transmission of hydraulic power therebetween. The compaction motor 188 may be configured as a single-direction, fixed displacement hydraulic motor, and the compaction pump 224 may be configured as a single flow-direction, variable displacement hydraulic pump. However, it will be appreciated that the compaction motor 188, the compaction pump 224, or both, may embody different configurations to meet application requirements.

The compaction pump 224 may include an actuator 240 that is configured to vary a displacement of the compaction pump 224. The actuator 240 may be operatively coupled to the controller 128 to enable the controller 128 to vary a displacement of the compaction pump 224 via the actuator 240. Accordingly, the controller 128 may vary a hydraulic flow rate to the compaction motor 188, and thereby vary a speed of the compaction motor 188.

An inlet port 228 of the compaction pump 224 may take suction from a reservoir 230 via an intake conduit 232, and an outlet port 234 of the compaction motor 188 may be fluidly coupled to the reservoir 230 via a return conduit 236. Further, the compaction pump 224 may be operatively coupled to the mechanical power source 112 via a shaft 238 for transmission of mechanical power therebetween. Accordingly, the compaction pump 224, the compaction motor 188, and the conduits 232, 226, 236 may form an open loop hydraulic circuit for transmitting mechanical power from the mechanical power source 112 to the compaction mechanism 130.

Although the hydraulic circuit to drive the compaction motor 188 is illustrated as an open-loop hydraulic circuit in FIG. 2, it will be appreciated that the hydraulic circuit to drive the compaction motor 188 may alternatively be configured as a closed-loop hydrostatic circuit, like those illustrated in FIG. 2 for driving the first propulsion motor 156 and the second propulsion motor 186, or any other hydraulic drive circuit known in the art. Similarly, although the hydraulic circuits to drive the first propulsion motor 156 and the second propulsion motor 186 are illustrated as closed-loop hydrostatic circuits in FIG. 2, it will be appreciated that hydraulic circuits for either of the first propulsion motor 156 and the second propulsion motor 186 may alternatively be configured as open-loop hydraulic circuits, including diverter valves to effect both forward and reverse operation, or any other hydraulic drive circuit known in the art.

Each of the shafts 238, 206, 174, and therefore each of the compaction pump 224, the second propulsion pump 196, and the first propulsion pump 164, may operate at the same rotational speed, as shown in FIG. 2. However, it will be appreciated that any of the shafts 238, 206, 174, and therefore any of the compaction pump 224, the second propulsion pump 196, and the first propulsion pump 164, may have separate and distinct connections to the mechanical power source 112, and therefore operate at a speed that is different from the other shafts or pumps.

Although FIG. 2 shows separate and distinct hydraulic circuits for the first propulsion pump 164 and the first propulsion motor 156, and the second propulsion pump 196 and the second propulsion motor 186, respectively, it will be appreciated that the first propulsion motor 156 and the second propulsion motor 186 may be incorporated into a single hydraulic circuit including any number of hydraulic pumps greater than or equal to one.

Figure 3:
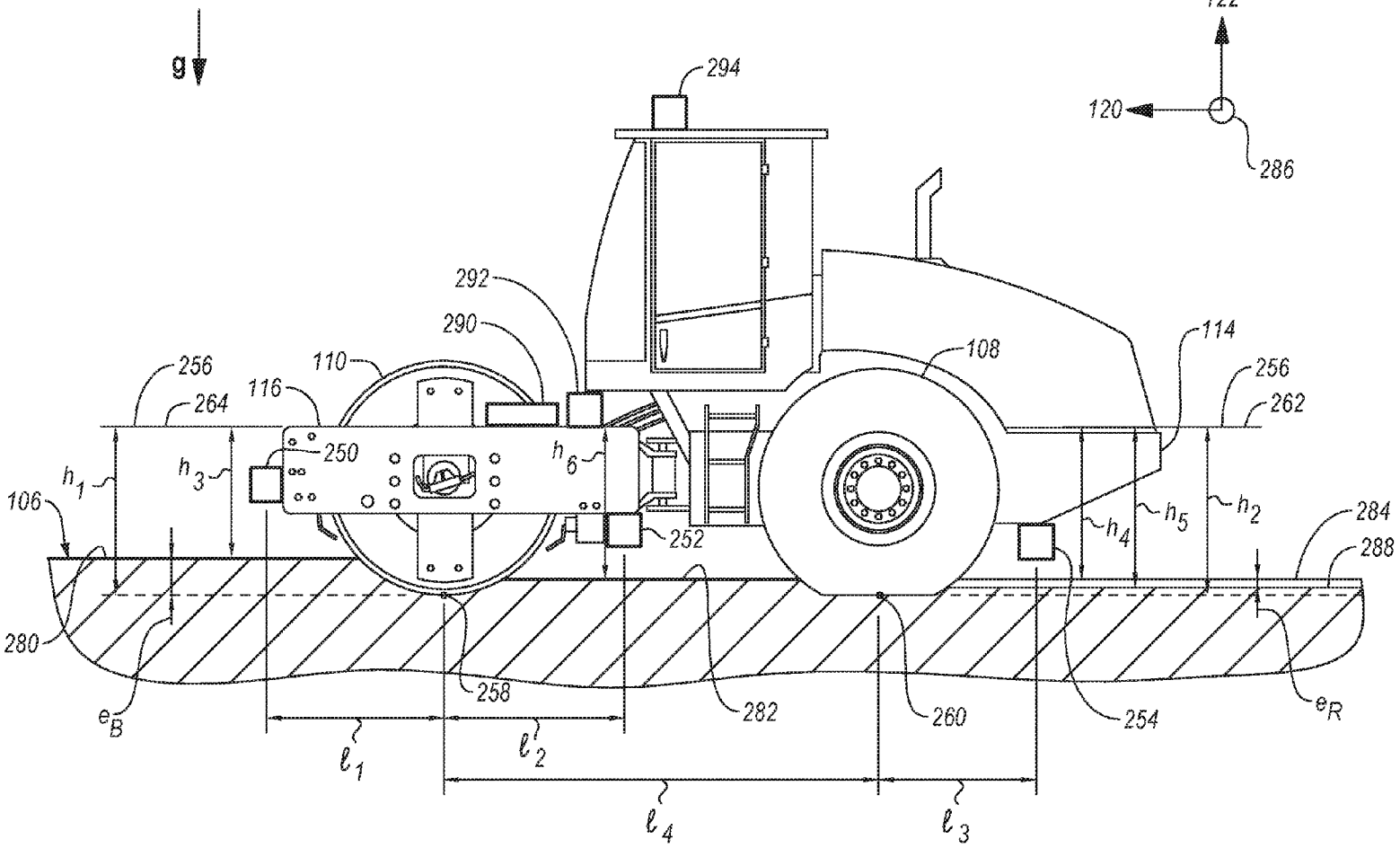
FIG. 3 is a side view of a compactor machine while performing a compaction process on a work surface, according to an aspect of the disclosure.

FIG. 3 is a side view of a compactor machine 100 while performing a compaction process on a work surface 106, according to an aspect of the disclosure. The compactor machine 100 may include at least one forward distance sensor 250, at least one middle distance sensor 252, and at least one rear distance sensor 254.

The at least one forward distance sensor 250 may be fixed to the second frame 116 forward of the compaction drum 110, where the forward direction extends along the longitudinal direction 120 from the propulsion device 108 toward the compaction drum 110. The at least one rear distance sensor 254 may be fixed to the first frame 114 aft of the propulsion device 108, where the aft direction is opposite the forward direction. The at least one middle distance sensor 252 may be fixed to the compactor machine between the propulsion device 108 and the compaction drum 110 along the longitudinal direction 120, and may be fixed to either the first frame 114 or the second frame 116. As shown in FIG. 3, the at least one middle distance sensor 252 is mounted to the second frame 116.

Furthermore, each or any of the distance sensors 250, 252, 254 may be mounted below the first frame 114 or the second frame 116 of the compactor machine 100 along the vertical direction 122, where the downward direction extends along the vertical direction 122 from the compactor machine 100 toward the work surface 106. Alternatively or additionally, each or any of the distance sensors 250, 252, 254 may be mounted on the compactor machine 100 such that the sensor has unobstructed line-of-sight or optical communication with the work surface 106.

Each of the distance sensors 250, 252, 254 may be configured to measure a distance between the compactor machine 100 and the work surface 106. According to an aspect of the disclosure, each of the distance sensors 250, 252, 254 is configured to measure a distance from a reference plane 256 of the compactor machine 100 to the work surface 106, normal or perpendicular to the reference plane 256. The reference plane 256 may be fixed in relation to the first frame 114, the second frame 116, or both, as the compactor machine 100 travels along the work surface 106. Alternatively or additionally, a first reference plane 262 may be defined in fixed relation to the first frame 114, and a second reference plane 264 may be defined in fixed relation to the second frame 116, where the second reference plane 264 is distinct from the first reference plane 262.

The reference plane 256 may be defined as a plane located above the work surface 106 and fixed in relation to the first frame 114 or the second frame 116 of the compactor machine 100, where the reference plane 256 is parallel to the work surface 106 when the work surface 106 is rigid and level. Thus, when the compactor machine 100 is disposed stationary on a rigid and level surface, a height $h_1$ from the reference plane 256 to the lowest point 258 on the compaction drum 110 may be equal to a height $h_2$ from the reference plane 256 to a lowest point 260 on the propulsion device 108. The first reference plane 262, the second reference plane 264, or both, may be defined similarly to the reference plane 256.

It will be appreciated that any of the reference planes 256, 262, 264 defined parallel to a rigid and level work surface 106 may only be a theoretical construct to aid the measurement of distances between the compactor machine 100 and the work surface 106 using the distance sensors 250, 252, 254, and may not correspond to any material surface of the compactor machine 100.

FIG. 3 shows the compactor machine 100 progressing in a forward longitudinal direction while compacting the work surface 106. A first portion 280 of the work surface 106 lies forward of the compaction drum 110 and is yet to be compacted by the compactor machine 100 during the current compaction pass. The at least one forward distance sensor 250 may be configured and arranged to measure the height $h_3$ to the first portion 280 of the work surface 106. A difference in height between $h_1$ and $h_3$ may define a sinking distance $e_B$ of the compaction drum 110. The sinking distance $e_B$ of the compaction drum 110 may include both elastic and plastic deformation of the work surface 106 in response to compaction by the compaction drum 110.

A second portion 282 of the work surface 106 is disposed between the compaction drum 110 and the propulsion device 108 along the longitudinal direction 120, and has been compacted by the compaction drum 110 but not by the propulsion device 108 during the current compaction pass. The at least one middle distance sensor 252 may be configured and arranged to measure the height $h_6$ to the second portion 282 of the work surface 106. A difference in height between $h_3$ and $h_6$ may be indicative of the plastic deformation of the work surface 106 in response to compaction by the compaction drum 110.

A third portion 284 of the work surface 106 is disposed aft of the propulsion device 108 along the longitudinal direction, within the track of the compaction drum 110, but outside the track of the propulsion device 108 along a transverse direction 286. The at least one rear distance sensor 254 may be configured and arranged to measure the height $h_4$ to the third portion 284 of the work surface. Accordingly, the height $h_4$ may be substantially equal to the height $h_6$, within variation of the work surface in the second portion 282 and the third portion 284, and within measurement uncertainty of the distance sensors 252 and 254. However, it will be appreciated that the height $h_4$ does not necessarily equal $h_6$ because a sinking depth of the compaction drum 110 into the work surface 106 may differ from a sinking distance of the one or more propulsion devices 108 in to the work surface 106.

A fourth portion 288 of the work surface 106 is disposed aft of the propulsion device 108 along the longitudinal direction, and in line with both the compaction drum 110 and the propulsion device 108 along the transverse direction 286. Therefore, the fourth portion 288 has been compacted by both the compaction drum 110 and the propulsion device 108. The at least one rear distance sensor 254 may be configured and arranged to measure the height 115 to the fourth portion 288 of the work surface.

A difference in height between $h_5$ and $h_4$ may define a sinking distance $e_R$ of the propulsion device 108 into the work surface 106. Accordingly, the sinking distance $e_R$ of the propulsion device 108 may include just the plastic deformation of the work surface 106 in response to compaction by the propulsion device 108. Alternatively, another sinking distance of the propulsion device 108 may be defined as the difference in height between $h_2$ and $h_4$, which may be indicative of both the plastic deformation and the elastic deformation of the work surface 106 in response to compaction by the propulsion device 108.

The at least one forward distance sensor 250 is located a distance $l_1$ from the point 258 along the longitudinal direction 120, and the at least one middle distance sensor 252 is located a distance $l_2$ from the point 258 along the longitudinal direction. The at least one rear distance sensor 254 is located a distance $l_3$ from the point 260 along the longitudinal direction 120. The point 258 is located a distance $l_4$ from the point 260 along the longitudinal direction, which may coincide with a distance from a rotational axis of the compaction drum 110 to a rotational axis of the propulsion device 108 along the longitudinal direction 120.

The compactor machine 100 may further include a longitudinal inclinometer 290, a cross slope sensor 292, a global positioning system (GPS) unit 294, or combinations thereof, fixed to either the first frame 114 or the second frame 116. According to an aspect of the disclosure, both the longitudinal inclinometer 290 and the cross slope sensor 292 are fixed to the second frame 116. Further, each of the longitudinal inclinometer 290, the cross slope sensor 292, and the GPS unit 294 may be operatively coupled to the controller 128 for transmission of measurement signals thereto.

The longitudinal inclinometer 290 may be configured and arranged to generate a signal that is indicative of a slope of the compactor machine 100 in a plane defined by the longitudinal direction 120 and the vertical direction 122. According to an aspect of the disclosure, the longitudinal inclinometer 290 measures the longitudinal inclination of the compactor machine 100 with respect to a gravity direction (g). Thus, it will be appreciated that the vertical direction 122 in machine coordinates need not align with the gravity direction (g).

The cross slope sensor 292 may be configured and arranged to generate a signal that is indicative of a slope of the compactor machine 100 in a plane defined by the vertical direction 122 and the transverse direction 286. According to an aspect of the disclosure, the cross slope sensor 292 measures the cross slope inclination of the compactor machine 100 with respect to the gravity direction (g). Each of the longitudinal inclinometer 290 and the cross slope sensor 292 may be operatively coupled to the controller 128 for communication of measurement signals therewith.

Figure 4:
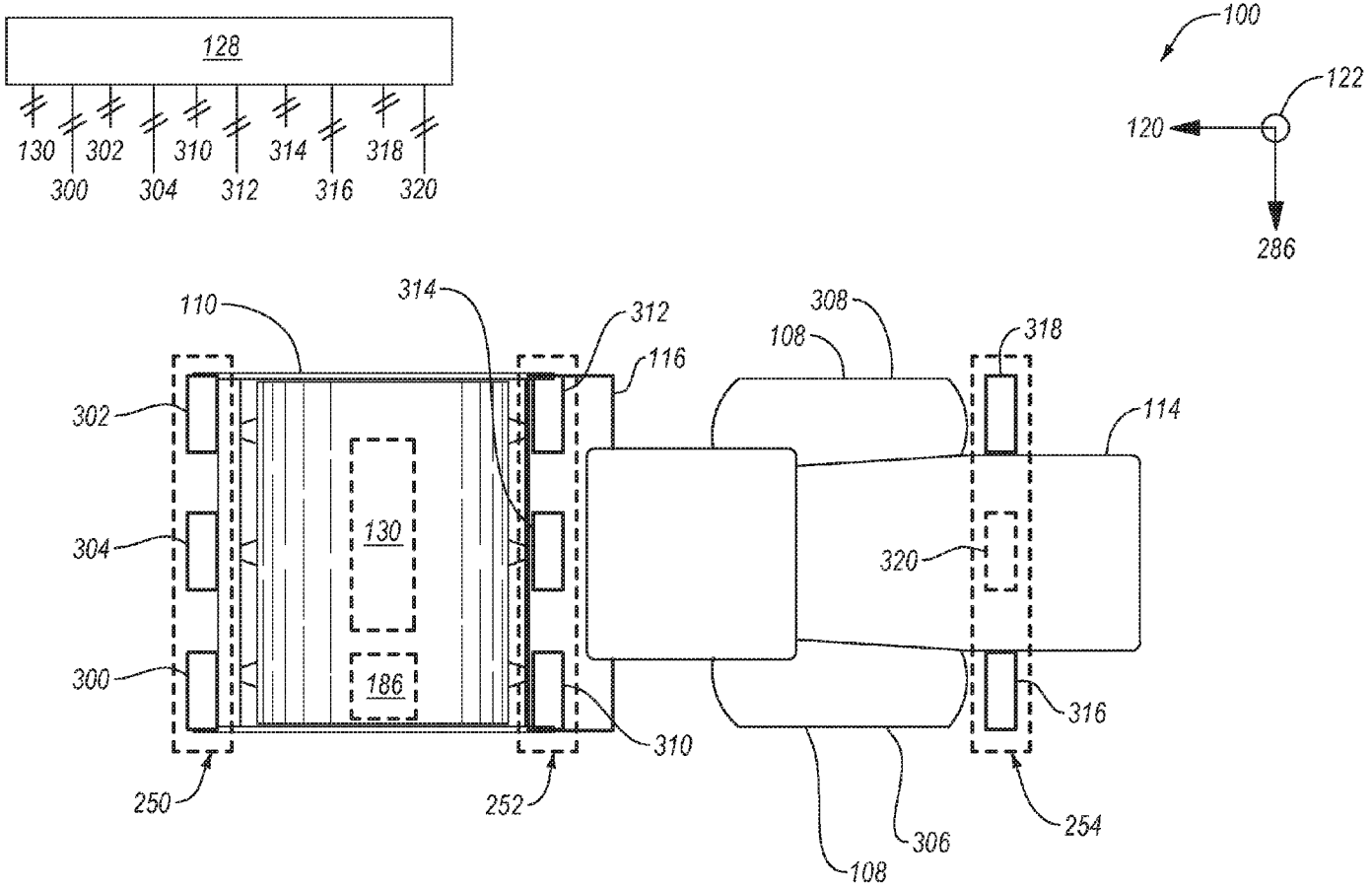
FIG. 4 is a top view of a compactor machine, according to an aspect of the disclosure.

FIG. 4 is a top view of a compactor machine 100, according to an aspect of the disclosure. The at least one forward distance sensor 250 may include a first forward distance sensor 300, a second forward distance sensor 302, a third forward distance sensor 304, or combinations thereof. Each of the first forward distance sensor 300, the second forward distance sensor 302, and the third forward distance sensor 304 may be located at the same longitudinal location along the longitudinal direction 120, and lie within a track of the compaction drum 110 along the transverse direction 286. Alternatively or additionally, the first forward distance sensor 300 and the second forward distance sensor 302 may be aligned with a track of a right propulsion device 306 and a track of a left propulsion device 308, respectively, along the transverse direction 286, and the third forward distance sensor 304 may be disposed between and outside of the tracks of the right propulsion device 306 and the left propulsion device 308 along the transverse direction 286.

Each of the first forward distance sensor 300, the second forward distance sensor 302, and the third forward distance sensor 304 may be operatively coupled to the controller 128 for transmission of height signals thereto. The controller 128 may be configured to perform arithmetic manipulations, statistical analysis, or both, on the signals from the first forward distance sensor 300, the second forward distance sensor 302, and the third forward distance sensor 304 to synthesize a value or a range of values indicative of distance to the first portion 280 of the work surface 106. According to an aspect of the disclosure, the controller 128 is configured to calculate an average value based on any two or more signals from the first forward distance sensor 300, the second forward distance sensor 302, and the third forward distance sensor 304.

The at least one middle distance sensor 252 may include a first middle distance sensor 310, a second middle distance sensor 312, a third middle distance sensor 314, or combinations thereof. Each of the first middle distance sensor 310, the second middle distance sensor 312, and the third middle distance sensor 314 may be located at the same longitudinal location along the longitudinal direction 120, and lie within a track of the compaction drum 110 along the transverse direction 286. Alternatively or additionally, the first middle distance sensor 310 and the second middle distance sensor 312 may be aligned with a track of a right propulsion device 306 and a track of a left propulsion device 308, respectively, along the transverse direction 286, and the third middle distance sensor 314 may be disposed between and outside of the tracks of the right propulsion device 306 and the left propulsion device 308 along the transverse direction 286.

Each of the first middle distance sensor 310, the second middle distance sensor 312, and the third middle distance sensor 314 may be operatively coupled to the controller 128 for transmission of height signals thereto. The controller 128 may be configured to perform arithmetic manipulations, statistical analysis, or both, on the signals from the first middle distance sensor 310, the second middle distance sensor 312, and the third middle distance sensor 314 to synthesize a value or a range of values indicative of distance between the first portion 280 of the work surface 106. According to an aspect of the disclosure, the controller 128 is configured to calculate an average value based on any two or more signals from the first middle distance sensor 310, the second middle distance sensor 312, and the third middle distance sensor 314.

The at least one rear distance sensor 254 may include a first rear distance sensor 316, a second rear distance sensor 318, a third rear distance sensor 320, or combinations thereof. Each of the first rear distance sensor 316, the second rear distance sensor 318, and the third rear distance sensor 320 may be located at the same longitudinal location along the longitudinal direction 120, and lie within a track of the compaction drum 110 along the transverse direction 286. Alternatively or additionally, the first rear distance sensor 316 and the second rear distance sensor 318 may be aligned with a track of a right propulsion device 306 and a track of a left propulsion device 308, respectively, along the transverse direction 286, and the third rear distance sensor 320 may be disposed between and outside of the tracks of the right propulsion device 306 and the left propulsion device 308 along the transverse direction 286.

Each of the first rear distance sensor 316, the second rear distance sensor 318, and the third rear distance sensor 320 may be operatively coupled to the controller 128 for transmission of height signals thereto. The controller 128 may be configured to perform arithmetic manipulations, statistical analysis, or both, on the signals from the first rear distance sensor 316, the second rear distance sensor 318, and the third rear distance sensor 320 to synthesize a value or a range of values indicative of distance between the first portion 280 of the work surface 106 and the reference plane 256, and distance between the third portion 284 of the work surface 106 and the reference plane 256. According to an aspect of the disclosure, the controller 128 is configured to calculate an average value based on signals from the first rear distance sensor 316 and the second rear distance sensor 318.

Figure 5:
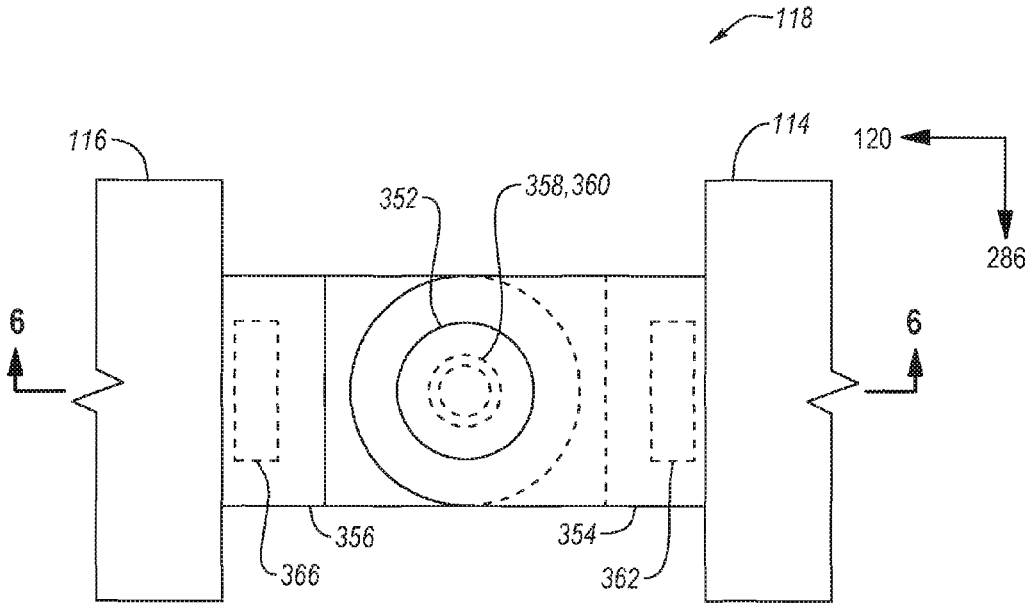
FIG. 5 is a top view of an articulated joint for a compactor machine, according to an aspect of the disclosure.
Figure 6:
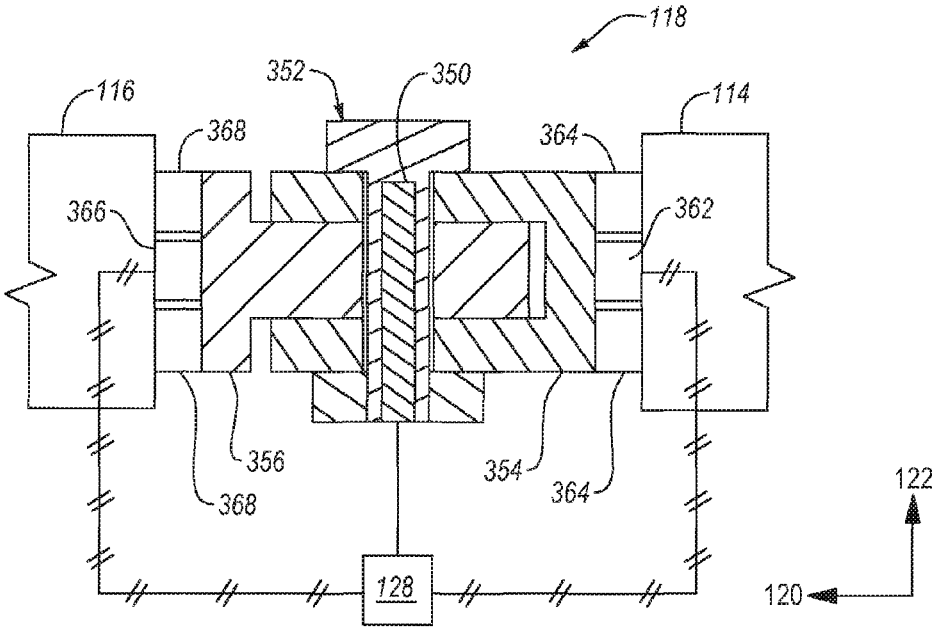
FIG. 6 is a partial cross-sectional view of an articulated joint along the section line 6-6 shown in FIG. 5, according to an aspect of the disclosure.

Referring now to FIGS. 5 and 6, it will be appreciated that FIG. 5 is a top view of an articulated joint 118 for a compactor machine 100, according to an aspect of the disclosure; and FIG. 6 is a partial cross-sectional view of an articulated joint 118 along the section line 6-6 shown in FIG. 5, according to an aspect of the disclosure. As shown in FIGS. 5 and 6, the compactor machine 100 includes at least one force sensor disposed along a force load path between the at least one propulsion device 108 and the compaction drum 110, such that the at least one force sensor is configured to generate a signal that is indicative of force transferred through the articulated joint 118.

According to an aspect of the disclosure, a force sensor 350 is incorporated into a pivot shaft 352 of the articulated joint 118. The articulated joint 118 may include a first yoke 354 pivotally coupled to a second yoke 356 via the pivot shaft 352, where the pivot shaft 352 passes through an aperture 358 of the first yoke 354 and an aperture 360 of the second yoke 356. The first yoke 354 may be fixed to the first frame 114, and the second yoke 356 may be fixed to the second frame 116, by fasteners, welding, combinations thereof, or any other fastening method known in the art.

The force sensor 350 may be operatively coupled to the controller 128 for transmission of force measurement signals thereto. According to an aspect of the disclosure, the force sensor 350 is subjected to the entirety of force transferred through the articulated joint 118, and the signal from the force sensor 350 is indicative of the entirety of the force being transferred through the articulated joint 118. Alternatively, the force sensor 350 may be subjected to only a portion of the force transferred through the articulated joint 118, and the controller 128 may be configured to determine the total force transfer through the articulated joint 118 based on the signal from the force sensor 350, calibration data, a physics-based model of force transfer through the articulated joint 118, or combinations thereof.

Alternatively or additionally, a force sensor 362 may be incorporated into a force load path between the articulated joint 118 and the at least one propulsion device 108. According to an aspect of the disclosure, the force sensor 362 may be disposed between the first yoke 354 and the first frame 114. Further, at least one spacer 364 may also be disposed between the first yoke 354 and the first frame 114.

Alternatively or additionally, a force sensor 366 may be incorporated into a force load path between the articulated joint 118 and the compaction drum 110. According to an aspect of the disclosure, the force sensor 366 may be disposed between the second yoke 356 and the second frame 116. Further, at least one spacer 368 may also be disposed between the second yoke 356 and the second frame 116.

The force sensor 362 and the force sensor 366 may be operatively coupled to the controller 128 for transmission of force measurement signals thereto. According to an aspect of the disclosure, the force sensor 362, the force sensor 366, or both, are subjected to the entirety of force transferred through the articulated joint 118, and the signal from respective force sensors are indicative of the entirety of the force being transferred through the articulated joint 118. Alternatively, the force sensor 362, the force sensor 366, or both, are subjected to only a portion of the force transferred through the articulated joint 118, and the controller 128 is configured to determine the total force transfer through the articulated joint 118 based on the signal from the force sensor 362, the signal from the force sensor 366, calibration data, a physical model of force transfer through the articulated joint 118, or combinations thereof. For example, a known fraction of the force transferred through the articulated joint 118 may be carried by the at least one spacer 364 or the at least one spacer 368, and the controller 128 may be configured to determine the total force transfer through the articulated joint 118 based at least in part on the force transferred by the at least one spacer 364 or the at least one spacer 368 relative to the force transferred through the force sensor 362 and the force sensor 366, respectively.

According to an aspect of the disclosure, the compactor machine 100 includes the force sensor 350 incorporated into the pivot shaft 352, and does not include either of the force sensors 362, 366. According to another aspect of the disclosure, the compactor machine 100 includes the force sensor 362, the force sensor 366, or both, but does not include the force sensor 350 incorporated into the pivot shaft 352.

Any of the force sensor 350, the force sensor 362, or the force sensor 366 may include a strain-gage type load cell, or any other force measurement device known in the art. Further, it will be appreciated that the representations of the articulated joint 118 in FIGS. 5 and 6 are simplified conceptual figures, which omit some practical features, such as bearings, to promote clarity of other features intended to be highlighted.

INDUSTRIAL APPLICABILITY

The present disclosure is applicable to compaction machines in general, and more particularly to compaction machines incorporating an articulated joint. The present disclosure is also applicable to methods for determination of compaction performance during a compaction process, and methods for calibrating a compaction system for determination of compaction performance during a compaction process.

Improved Determination of Longitudinal Slope

Determination of compaction performance during a compaction process may depend upon, or be at least partly based upon, a determination of the longitudinal slope (a) of the work surface 106 relative to the gravity direction (g) in a plane defined by the longitudinal direction 120 and the vertical direction 122 of the compactor machine 100. The compactor machine 100 may include the longitudinal inclinometer 290, which is configured to generate a signal (as) indicative of a longitudinal slope of the compactor machine 100 relative to the gravity direction (g) in a plane defined by the longitudinal direction 120 and the vertical direction 122.

However, the Applicant recognized that the longitudinal slope of the compactor machine 100 may differ from the longitudinal slope of the work surface 106 because of a zero-offset error ($\alpha_0$) in the slope indication of the longitudinal inclinometer 290 when the compactor machine 100 is at rest on a rigid and level surface, because of a difference between the sinking distance ($e_B$) of the compaction drum 110 into the work surface 106 and the sinking distance ($e_R$) of the propulsion devices 108 into the work surface 106, or combinations thereof. Accordingly, the Applicant discloses herein apparatus and methods for adjusting a longitudinal slope measurement signal ($\alpha_S$) to be more indicative of the true longitudinal slope ($\alpha$) of the work surface 106 by correcting for deviations therebetween.

The zero-offset error ($\alpha_0$) of the longitudinal inclinometer 290 may result, for example, from change in overall diameter of the propulsion devices 108 due to tread wear or changes in pneumatic tire inflation pressure, from change in the outer diameter of the compaction drum 110 due to wear, drift in the calibration of the longitudinal inclinometer 290, or combinations thereof. The magnitude of the zero-offset error ($\alpha_0$) of the longitudinal inclinometer 290 may be determined by measuring a slope output signal from the longitudinal inclinometer 290 while the compactor machine 100 is resting on a firm reference surface of known longitudinal slope, thereby performing a zero calibration of the longitudinal inclinometer 290. According to an aspect of the disclosure the known longitudinal slope is a level longitudinal slope.

The result from the zero calibration of the longitudinal inclinometer 290 may be applied in at least two ways. First, the difference ($\alpha_0$) between the measured slope based on the slope signal of the longitudinal inclinometer 290 and the known longitudinal slope of the reference surface may be recorded, for example, in a memory of the controller 128 and applied as a correction to longitudinal slope measurements using the longitudinal inclinometer 290. Alternatively, relationships for determining the longitudinal slope based on the slope signal from the longitudinal inclinometer 290 may be adjusted such that following the calibration procedure, the slope indicated by the longitudinal inclinometer 290 matches the longitudinal slope of the reference surface, such that $\alpha_0$ equals zero following calibration.

As discussed previously with reference to FIG. 3, the sinking distance ($e_B$) of the compaction drum 110 into the work surface 106 may be calculated based on one or more height measurements ($h_3$) from the at least one forward distance sensor 250 and design information ($h_1$) of the compactor machine 100 as shown in Equation 1.

$$e_B=h_1-h_3 \qquad \text{Equation 1}$$

Also as previously discussed with reference to FIG. 3, the sinking distance ($e_R$) of the at least one propulsion device 108 into the work surface 106 may be calculated based on one or more height measurements ($h_4$) from the at least one rear distance sensor 254 and design information ($h_2$) of the compactor machine 100 as shown in Equation 2.

$$e_R=h_5-h_4 \qquad \text{Equation 2}$$

Accordingly, the longitudinal slope ($\alpha$) of the work surface 106 may be calculated based at least in part on the longitudinal slope signal ($\alpha_S$) measured from the longitudinal inclinometer 290 and select correction factors as shown in Equation 3.

$$\alpha=\alpha_S-\alpha_0-\arctan((e_B-e_R)/(l_4+l_1+l_3)) \qquad \text{Equation 3}$$

Machine Drive Power (MDP) Indication of Compactor Performance

The Applicant recognized that rolling resistance of a load in rolling engagement with a work surface 106 depends upon the density of the material, the stiffness of the material, or combinations thereof. In turn, the Applicant developed the MDP material compaction measurement technology based on rolling resistance of the compactor machine 100 over the work surface 106 to help the operator of the compactor machine 100 determine when the load bearing strength of the material being compacted meets specification. For example, as the material of a work surface 106 is progressively compacted by multiple passes of a compactor machine 100, the power required to propel the compactor machine 100 over the work surface 106 decreases with each successive pass that further compacts the work surface 106.

The minimum rolling resistance of a compactor machine 100 corresponds to an ideally flat, bearing (i.e., optimally stiff, dense, or both), and level (i.e., normal to gravity direction) surface. The force necessary to propel the compactor machine 100 over such an idealized surface is designated herein as $F_{MDP}$. The value of $F_{MDP}$ may be evaluated using physics-based models, or by measuring a rolling resistance of a compactor machine 100 over the real surface of a test strip that approaches the idealized surface, or that corresponds to a target density and flatness. A stiffness or density of a test strip of material on a work surface 106 may be characterized by conventional means such as analysis of extracted core samples, nuclear gages, electromagnetic measurement devices, or any other work surface density or stiffness measurement technique known in the art.

Accordingly, an MDP value may be defined by normalizing a current rolling resistance (F) of a compactor machine 100 over a work surface 106 by the idealized MDP rolling resistance ($F_{MDP}$) as shown in Equation 4.

$$MDP=F/F_{MDP}\geq 1 \qquad \text{Equation 4}$$

As the value of $F_{MDP}$ corresponds to an absolute or virtual minimum of rolling resistance, it will be appreciated that any current rolling resistance (F) will be larger than $F_{MDP}$, and therefore MDP will be greater than or equal to one. It will be further appreciated that as the density or stiffness of the work surface 106 approaches the target or ideal density or stiffness, the measured MDP value will approach a value of one.

To help make the increase in material density or stiffness more intuitive to an operator of the compactor machine 100, a scaled reciprocal of the MDP value (MDP*) may be presented on a display of the one or more control devices 126, as defined in Equation 5.

$$MDP^*=k/MDP \qquad \text{Equation 5}$$

Therefore, MDP* will always be less than or equal to the scaling constant, k, and higher values of MDP* correspond to higher values of density or stiffness of the material of the work surface 106. According to a non-limiting aspect of the disclosure, k=150, and therefore MDP*≤150.

According to conventional approaches of the MDP compactor performance measurement technique, rolling resistance force was not directly measured, but instead was estimated using other measurements and physical models for the interaction of the compactor machine 100 with the work surface 106. For example, a sum of propulsion power delivered to the work surface via the one or more rolling elements 104 could be estimated by determining a total amount of mechanical power generated by the mechanical power source 112, and then determining or estimating the fraction of the total power from the mechanical power source 112 that is delivered to the one or more rolling elements 104. Then, the rolling resistance for the rolling elements 104 could be determined as the mechanical power to the rolling elements 104 divided by the land speed of the compactor machine 100 that corresponds to the mechanical power of the rolling elements 104 so determined.

Alternatively, when the one or more rolling elements 104 are powered by hydraulic circuits, for example, power for all of the rolling element 104 could be determined or estimated as the product of pressure drop across and hydraulic flow rate through corresponding hydraulic motors. Next, the rolling resistance force could be determined or estimated by dividing the sum of hydraulic power to the rolling elements 104 by the land speed of the compactor machine 100 that corresponds to the sum of hydraulic power to the rolling elements 104.

It may be desirable to consider power consumed or contributed to the compactor machine 100 when the compactor machine 100 travels up a longitudinal slope ($\alpha$) or down a longitudinal slope ($\alpha$), respectively, when performing an MDP analysis. Indeed, when the compactor machine 100 is traveling up a longitudinal slope, against the acceleration of gravity (g), additional force must be applied to perform work against gravity, but this additional force is not necessarily indicative of increased rolling resistance at any of the rolling elements 104. Therefore, the total force ($F_{total}$) acting to propel the compactor machine 100 should be reduced by the component of the compactor machine's mass ($m_{machine}$) acting down the longitudinal slope ($\alpha$) to determine or estimate the rolling resistance force (F) as shown in Equation 6.

$$F=F_{total}-m_{machine}*g*\sin(\alpha) \quad \text{Equation 6}$$

Similarly, when the compactor machine 100 is traveling down a longitudinal slope, aided by the acceleration of gravity (g), less force must be derived from the mechanical power source 112 because of the aid of gravity. Therefore, the total force ($F_{total}$) acting to propel the compactor machine 100 should be increased by the component of the compactor machine's mass ($m_{machine}$) acting down the longitudinal slope ($\alpha$) to determine or estimate the rolling resistance force (F). Thus, as presented in Equation 6, the longitudinal slope angle ($\alpha$) is positive when the compactor machine 100 is traveling uphill, and the longitudinal slope angle ($\alpha$) is negative when the compactor machine 100 is traveling downhill. The coordinate system could alternately be arranged such that the longitudinal slope ($\alpha$) is negative when the compactor machine 110 is traveling uphill, and positive when traveling downhill, and in turn the sign of sin(a) will change with the sign of $\alpha$. It will be appreciated, as discussed above, that the longitudinal slope ($\alpha$) of the work surface 106 may be determined by correcting a measured longitudinal slope ($\alpha_S$) of the compactor machine 100, using a signal from the longitudinal inclinometer 290.

Although conventional MDP approaches to continuous measurement of work surface 106 density or stiffness greatly benefit operators of a compactor machine 100, the Applicant discovered that variations in the geometry of the rolling elements 104 themselves could contribute variability and uncertainty in the resulting rolling force determinations. Especially with respect to pneumatic tires, changes in inflation pressure and changes in the tire tread through normal wear could bias determinations or estimates of rolling resistance based on propulsive power delivered to the pneumatic tires as propulsion devices 108.

Drum-Scale MDP Based on Drum Rolling Resistance with Direct Force Measurement and Drum Propulsion Deactivated The Applicant discovered that direct measurement of rolling resistance force through the articulated joint 118 could reduce or eliminate some of the aforementioned variances and uncertainties associated with propulsion devices 108, such as pneumatic tires. By deactivating propulsion power delivered to the compaction drum 110, and thereby providing all propulsion power to the compactor machine 100 via the one or more propulsion devices 108 on the first frame 114, measurement of force transferred through the articulated joint 118 from the first frame 114 to the second frame 116 may be a direct measurement of the rolling resistance force of the compaction drum 110, after adjustment for the longitudinal slope. This mode of operation may be referred to as a "measurement mode" of the compactor machine 100.

Accordingly, an MDP method may be applied where the idealized MDP force ($F_{MDP}$) is an idealized MDP rolling resistance force of the compaction drum 110 alone ($F_{MDP,B}$) over an idealized work surface 106, and the current rolling resistance of the compaction drum 110 ($F_S$) is directly measured using one or more of the force sensors 350, 362, 366, as previously described with respect to FIGS. 5 and 6, for example. Furthermore, adjustments for the longitudinal slope ($\alpha$) may be applied by determining a component of the axle load acting on the compaction drum 110 ($F_{A,B}$) along the gravity direction (g). Accordingly an MDP* indication for the compaction drum 110 using measured force transferred through the articulated joint 118 may be calculated as shown in Equation 7.

$$MDP^*_{drum}=k*F_{MDP,B}/(F_S-F_{A,B}) \quad \text{Equation 7}$$

The axle force ($F_{A,B}$) acting on the axle of the compaction drum 110 may depend upon a mass ($m_B$) of the compactor machine 100 disposed forward of the articulated joint 118, and a force ($F_T$) corresponding to a portion of the mass of the trolley acting on the axle of the compaction drum via the articulated joint 118. The forward mass ($m_B$) may include the mass of the compaction drum 110, and its corresponding driving mechanisms, and the second frame 116. The trolley force ($F_T$) acting on the axle of the compaction drum 110 along the gravity direction (g) may be determined as a function of the longitudinal slope ($\alpha$) from a physics-based model of the compactor machine 100, lab or field measurements of the load carried by the axle of the compaction drum 110, combinations thereof, or any other method known in the art for determining an axle load. According to an aspect of the disclosure, the axle load ($F_{A,B}$) in Equation 7 may be determined or estimated by the relation in Equation 8.

$$F_{A,B}=F_T+m_B*g*\sin(\alpha) \quad \text{Equation 8}$$

Referring to FIG. 2, it will be appreciated that propulsion power to the second propulsion motor 186 may be deactivated by setting the second propulsion pump 196 displacement to zero using the actuator 208, and the compaction drum 110 is configured to rotate freely by opening the second bypass valve 212 via the actuator 214, opening the second clutch 216, combinations thereof, or any other method known in the art for causing the compaction drum 110 to rotate freely independent of the second propulsion pump 196.

It will be appreciated that a value for $F_{MDP,\ drum}$ may be determined from measurement of the force transferred through the articulated joint 118 when the above-noted method is performed with the compactor machine 100 disposed on a compacted work surface 106 that closely approximates the idealized flat, bearing, and level surface associated with minimum rolling resistance, or a work surface 106 that approximates a target compaction for the work surface 106. Further, it will be appreciated that the above-noted procedure may be performed with or without power transfer to the compaction mechanism 130.

Although the MDP* value calculated in Equation 7 does not include rolling resistance for the one or more propulsion devices 108, it will be appreciated that considering rolling resistance of the compaction drum 110 alone may provide a repeatable and reproducible way for determining or estimating progress toward a target density or stiffness for the work surface 106, when force transferred through the articulated joint 118 is directly measured.

According to another aspect of the disclosure, the controller 128 may configure the compactor machine 100 to operate in an alternate measurement mode, where propulsion power to the one or more propulsion devices 108 is deactivated, the compactor machine 100 is propelled over the work surface 106 by applying propulsion power to the compaction drum 110, and a rolling resistance of the one or more propulsion devices 108 is determined based on a measurement of force transmitted from the second frame 116 to the first frame 114 via the articulated joint 118.

In this alternate mode, propulsion power to the propulsion devices 108 may be deactivated by setting a displacement of the first propulsion pump 164 to zero. Further, the propulsion devices 108 may be configured to operate in a neutral or free-wheeling mode by opening the first bypass valve 180, disengaging or opening the first clutch 184, or combinations thereof. It will be appreciated that this alternate measurement mode may be used to characterize or calibrate a rolling resistance of the propulsion devices 108.

Drum-Scale MDP Based on Drum Rolling Resistance with Direct Force Measurement and Drum Propulsion Activated While the drum-scale MDP method described above, with propulsion power to the compaction drum 110 deactivated, may be a useful for determining density or stiffness of the work surface 106, it may still be desirable to incorporate the articulated joint 118 force measurement into a drum-scale MDP method when propulsion power is delivered to both the compaction drum 110 and the one or more propulsion devices 108. This mode of operation may be referred to as a "working mode" of the compactor machine 100.

It will be appreciated that the direct force measurement through the articulated joint 118 will tend to underestimate the force required to overcome rolling resistance of the compaction drum 110 when additional propulsion power is delivered to the compaction drum 110 in addition to the one or more propulsion devices 108. However, the force necessary to propel the compaction drum 110 against rolling resistance of the work surface 106 and the longitudinal slope may include the force measured through the articulated joint 118 in addition to a propulsion force derived from propulsion power consumed by the compaction drum 110.

Propulsion power delivered to the compaction drum 110, for example via the second propulsion motor 186 (see FIG. 2) will impart a propulsion force to the second frame 116 that is not included in the articulated joint 118 force measurement. However, an effective force acting on the compaction drum 110 in response to propulsion power applied to the compaction drum 110 may be derived as follows, and incorporated into the drum MDP method.

Referring now to FIG. 2, a propulsion power delivered to the compaction drum 110 may be determined or estimated as the product of the pressure drop across the second propulsion motor 186 and the flow rate of hydraulic fluid through the second propulsion motor 186. The pressure drop across the second propulsion motor 186 may be measured directly by the pressure sensor 210, and the flow rate of hydraulic fluid through the second propulsion motor 186 may be determined or estimated based on a speed of the second propulsion pump 196 and a displacement of the second propulsion pump 196. If present in the system, it will be appreciated that the second bypass valve 212 will be closed and the second clutch 216 will be engaged to transfer hydraulic power from the second propulsion pump 196 to the second propulsion motor 186.

Simultaneously with determining pressure drop and flow rate through the second propulsion motor 186, a land speed of the compactor machine 100 over the work surface 106 and a longitudinal slope of the work surface 106 are determined. Next, an effective force based on drum propulsion ($F_{drum,\ propulsion}$) may be calculated as the propulsion power delivered to the compaction drum 110 divided by the land speed of the compactor machine 100. Then, the effective force based on drum propulsion ($F_{drum,\ propulsion}$) may be integrated into the $MDP^*_{drum}$ calculation as shown in Equation 9.

$$MDP^*_{drum}=k^*F_{MDP,B}/(F_S+F_{drum,propulsion}-F_{A,B}) \qquad \text{Equation 9}$$

According to an aspect of the disclosure, the axle load ($F_{A,B}$) in Equation 9 may be determined or estimated by the relation in Equation 8 above.

Thus, although the MDP* calculation shown in Equation 9 introduces some additional complexity and perhaps some uncertainty regarding propulsion power delivered to the compaction drum 110, it enables an MDP approach where both the compaction drum 110 and the propulsion devices 108 are simultaneously driven by propulsion power, without adding uncertainties that may result from introduction of propulsion power applied to pneumatic tires, for example, into the MDP calculations.

Determination of Relative Rolling Slump without Elastic Deformation of the Work Surface Using measurements from the at least one middle distance sensor 252 in conjunction with aforementioned measurements from the at least one forward distance sensor 250 and the at least on rear distance sensor 254, a relative rolling slump ($\Delta e_B$) may be determined, and may be used to estimate the development of the stiffness of the material being compacted in the work surface 106 over multiple passes.

Referring to FIG. 3, a measurement of the distance $h_6$ may be performed by the one or more middle distance sensors 252. According to an aspect of the disclosure, the distance $h_6$ may result from an average of two or more distance sensors included in the at least one middle distance sensor 252. It will be appreciated, however, that the measurement of the distance $h_6$ and the measurement $h_3$ may be confounded by the distance ($e_B$) that the compaction drum 110 sinks into the work surface 106, and the distance ($e_R$) that the at least one propulsion device 108 sinks into the work surface 106. As next described, the measured values of the distances $h_3$ and $h_6$ may be corrected using a correction angle ($\beta$) to yield corrected values, $h_3$* and $h_6$*, which may in turn be used to calculate the relative rolling slump ($\Delta e_B$).

The correction angle ($\beta$) may be defined by the following relationship in Equation 10.

$$\arctan(\beta)=e_R/(l_4+l_3) \qquad \text{Equation 10}$$

The correction magnitudes, $h_3'$ and $h_6'$, corresponding to the measurement values of $h_3$ and $h_6$, respectively, can be calculated as shown in Equations 11 and 12.

$$h_6'=l_2^*\tan(\beta) \qquad \text{Equation 11}$$

$$h_3'=l_1*\tan(\beta) \quad \text{Equation 12}$$

The corrected values, $h_3*$ and $h_6*$, may be calculated as shown in Equations 13 and 14.

$$h_6*=h_6-h_6' \quad \text{Equation 13}$$

$$h_3*=h_3-h_3' \quad \text{Equation 14}$$

And finally, including the elastic recovery of the soil, the relative rolling slump ($\Delta e_B$) may be calculated as shown in Equation 15.

$$\Delta e_B=|h_3*-h_6*| \quad \text{Equation 15}$$

In practice, the absolute value of $\Delta e_B$ may be convenient for use as the relative rolling slump for the purpose of tracking incremental increases in stiffness or density of the working surface 106, as next discussed.

Figure 7:
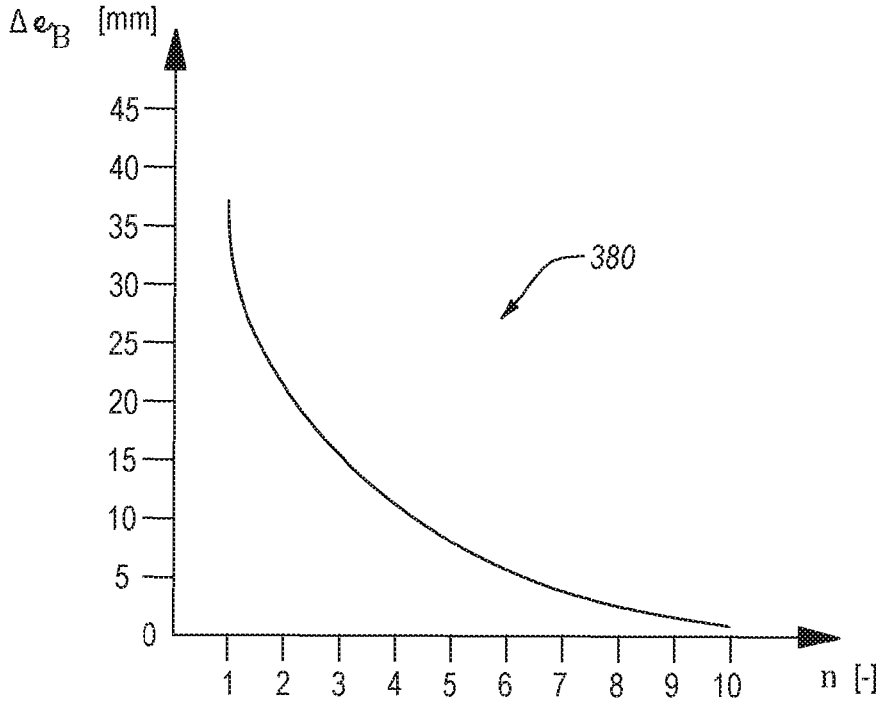
FIG. 7 is an exemplary plot of relative rolling slump versus a number of passes over a work surface, according to an aspect of the disclosure.

FIG. 7 is an exemplary plot 380 of relative rolling slump versus a number of passes over a work surface, according to an aspect of the disclosure. As shown in FIG. 7, successive passes of the compactor machine 100 over the work surface 106 may result in a monotonically decreasing trend in the magnitude of the relative rolling slump $\Delta e_B$ that asymptotically approaches zero. It will be appreciated that GPS technology, or any other technology known in the art for tracking a machine on a work surface 106, may be used to pair relative rolling slump values with a specific location on the work surface 106. Accordingly, a trend of relative rolling slump may be provided to an operator of the compactor machine 100 as the compactor machine traverses successive passes over the work surface 106, to aid the operator in knowing when optimum or target compaction is achieved.

Figure 8:
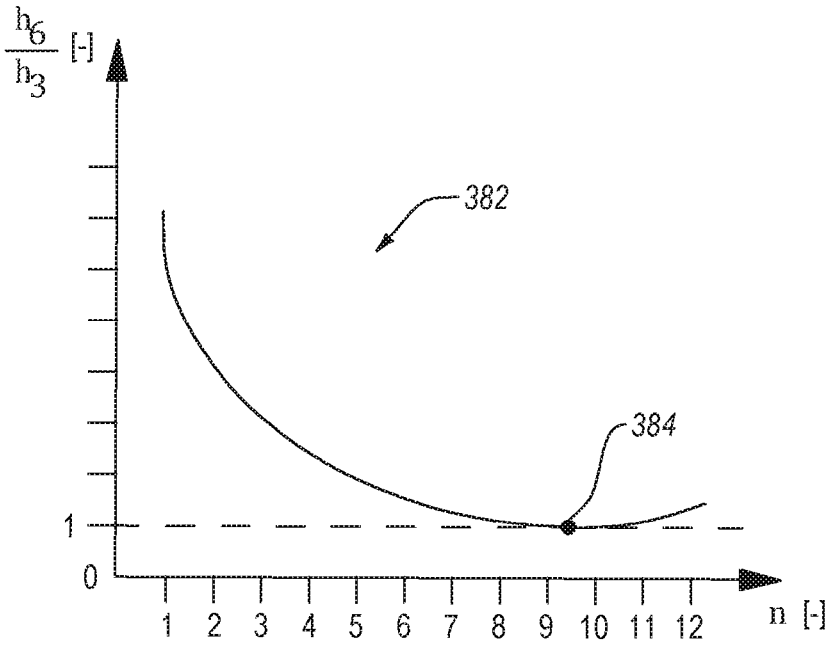
FIG. 8 is an exemplary plot of a distance ratio $h_6/h_3$ versus a number of passes over a work surface, according to an aspect of the disclosure.

FIG. 8 is an exemplary plot 382 of a distance ratio $h_6/h_3$ versus a number of passes over a work surface, according to an aspect of the disclosure. As shown in FIG. 8, the distance ratio of $h_6/h_3$, measured from the at least one middle distance sensor 252 and the at least one forward distance sensor 250, may initially decreases monotonically with successive passes of the compactor machine 100 over the work surface 106. However, the distance ratio $h_6/h_3$ may eventually exhibit a local minimum 384, near a value of one, beyond which indicating that additional passes may tend to decrease the density or stiffness of the work surface 106. It will be appreciated that GPS technology, or any other technology known in the art for tracking a machine on a work surface 106, may be used to pair values of the distance ratio $h_6/h_3$ with a specific location on the work surface 106. Accordingly, a trend of the distance ratio $h_6/h_3$ may be provided to an operator of the compactor machine 100 as the compactor machine traverses successive passes over the work surface 106, to aid the operator in knowing when optimum or target compaction is achieved.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The controller 128 may be any purpose-built processor for effecting control of the compactor machine 100 or the compaction system 102. It will be appreciated that the controller 128 may be embodied in a single housing, or a plurality of housings distributed throughout the compactor machine 100 or the compaction system 102. Further, the controller 128 may include power electronics, preprogrammed logic circuits, data processing circuits, volatile memory, non-volatile memory, software, firmware, input/output processing circuits, combinations thereof, or any other controller structures known in the art.

Any of the methods or functions described herein may be performed by or controlled by the controller 128. Further, any of the methods or functions described herein may be embodied in a computer-readable non-transitory medium for causing the controller 128 to perform the methods or functions described herein. Such computer-readable non-transitory media may include magnetic disks, optical discs, solid state disk drives, combinations thereof, or any other computer-readable non-transitory medium known in the art. Moreover, it will be appreciated that the methods and functions described herein may be incorporated into larger control schemes for an engine, a machine, or combinations thereof, including other methods and functions not described herein.

We claim:

1. A compaction system, comprising:

a first frame;

a second frame pivotally coupled to the first frame via an articulated joint;

a first propulsion device operatively coupled to the first frame via a first propulsion motor, the first propulsion device being configured to propel the compaction system over a work surface in response to a power applied by the first propulsion motor;

a compaction drum operatively coupled to the second frame, the compaction drum being configured to compact the work surface via rolling engagement with the work surface;

a force sensor configured and arranged to generate a signal that is indicative of a propulsion force transferred through the articulated joint; and a controller operatively coupled to the force sensor, the controller being configured to determine compaction performance of the compaction system against the work surface based at least in part on the signal from the force sensor.

2. The compaction system of claim 1, wherein the compaction performance of the compaction system includes at least one of a change in a density of the work surface in response to the rolling engagement of the compaction system against the work surface, a change in a vertical height of the work surface in response to the rolling engagement of the compaction system against the work surface, and a change in a stiffness of the work surface in response to the rolling engagement of the compaction system against the work surface.

3. The compaction system of claim 1, wherein the compaction drum is operatively coupled to the second frame via a second propulsion motor, the second propulsion motor being configured to selectively apply a propulsion power to the compaction drum, such that the compaction drum is also configured to propel the compaction system over the work surface, and wherein the controller is further configured to deactivate the second propulsion motor, thereby deactivating the propulsion power to the compaction drum, and determine the compaction performance of the compaction drum while the second propulsion motor is deactivated.

4. The compaction system of claim 1, wherein the first propulsion device includes a pneumatic tire configured to engage the work surface.

5. The compaction system of claim 1, wherein the articulated joint includes a pivot shaft, and the force sensor is incorporated into the pivot shaft.

6. The compaction system of claim 1, further comprising at least one front distance sensor mounted to the second frame, the at least one front distance sensor being configured and arranged to generate a signal that is indicative of a distance from the at least one front distance sensor to the work surface; and at least one rear distance sensor mounted to the first frame, the at least one rear distance sensor being configured and arranged to generate a signal that is indicative of a distance from the at least one rear distance sensor to the work surface, wherein the controller is also operatively coupled to the at least one front distance sensor and the at least one rear distance sensor, and the controller is further configured to determine a longitudinal slope of the work surface based at least in part on the signal from the at least one front distance sensor and the signal from the at least one rear distance sensor.

7. The compaction system of claim 6, wherein the at least one front distance sensor includes a plurality of front distance sensors, each front distance sensor of the plurality of front distance sensors being distributed along a transverse direction, wherein the at least one rear distance sensor includes a plurality of rear distance sensors, each rear distance sensor of the plurality of rear distance sensors being distributed along the transverse direction, and wherein the transverse direction is transverse to a longitudinal direction.

8. The compaction system of claim 6, further comprising at least one middle distance sensor mounted to one of the first frame and the second frame, the at least one middle distance sensor being mounted between a rotational axis of the first propulsion device and a rotational axis of the compaction drum along a longitudinal direction, the at least one middle distance sensor being configured and arranged to generate a signal that is indicative of a distance from the at least one middle distance sensor to the work surface, wherein the controller is also operatively coupled to the at least one middle distance sensor, and the controller is further configured to determine a relative rolling slump based on the signal from the at least one front distance sensor, the at least one middle distance sensor, and the at least one rear distance sensor.

9. The compaction system of claim 1, wherein the compaction drum is operatively coupled to the second frame via a second propulsion motor, the second propulsion motor being configured to selectively apply a propulsion power to the compaction drum, such that the compaction drum is also configured to propel the compaction system over the work surface, and wherein the controller is further configured to apply propulsion power to the second propulsion motor, and determine the compaction performance of the compaction system against the work surface based at least in part on the signal from the force sensor and the propulsion power applied to the second propulsion motor.

10. The compaction system of claim 9, wherein the compaction performance of the compaction system against the work surface is not determined based on the power applied by the first propulsion motor to the first propulsion device.

11. A method for compacting a work surface with a compaction system, the compaction system including a first propulsion device operatively coupled to a compaction drum via an articulated joint, a force sensor configured and arranged to generate a signal indicative of a propulsion force transferred from the first propulsion device to the compaction drum via the articulated joint, and a controller operatively coupled to the force sensor, the method comprising:

propelling the compaction system over the work surface by applying a propulsion power to a first propulsion device in contact with the work surface;

compacting the work surface in response to the propelling the compaction system over the work surface; and determining via the controller a first compaction performance of the compaction system against the work surface based at least in part on the signal from the force sensor.

12. The method of claim 11, wherein the first compaction performance of the compaction system includes at least one of a change in a density of the work surface in response to a rolling engagement of the compaction system against the work surface, a change in a vertical height of the work surface in response to the rolling engagement of the compaction system against the work surface, and a change in a stiffness of the work surface in response to the rolling engagement of the compaction system against the work surface.

13. The method of claim 11, wherein the determining the first compaction performance of the compaction system is not determined based on the propulsion power applied to the first propulsion device.

14. The method of claim 11, further comprising deactivating a propulsion power to the compaction drum, wherein the determining the first compaction performance of the compaction system is performed while the propulsion power to the compaction drum is deactivated.

15. The method of claim 11, further comprising propelling the compaction drum across the work surface by applying a propulsion power to the compaction drum and applying the propulsion power to the first propulsion device, wherein the determining the first compaction performance of the compaction system includes is based on the signal from the force sensor and a magnitude of the propulsion power applied to the compaction drum.

16. A machine for compacting a work surface, the machine comprising:

a first frame;

a second frame coupled to the first frame via an articulated joint;

a first propulsion device operatively coupled to the first frame via a first propulsion motor, the first propulsion device being configured to propel the machine over a work surface in response to a power applied by the first propulsion motor;

a compaction drum operatively coupled to the second frame, the compaction drum being configured to compact the work surface via rolling engagement with the work surface;

a force sensor configured and arranged to generate a signal that is indicative of a propulsion force transferred through the articulated joint; and a controller operatively coupled to the force sensor, the controller being configured to determine compaction performance of the machine the work surface based at least in part on the signal from the force sensor.

17. The machine of claim 16, wherein the compaction drum is operatively coupled to the second frame via a second propulsion motor, the second propulsion motor being configured to selectively apply a propulsion power to the compaction drum, such that the compaction drum is also configured to propel the machine over the work surface, and wherein the controller is further configured to deactivate the second propulsion motor, thereby deactivating the propulsion power to the compaction drum, and determine the compaction performance of the compaction drum while the second propulsion motor is deactivated.

18. The machine of claim 16, wherein the compaction drum is operatively coupled to the second frame via a second propulsion motor, the second propulsion motor being configured to selectively apply a propulsion power to the compaction drum, such that the compaction drum is also configured to propel the machine over the work surface, and wherein the controller is further configured to apply propulsion power to the second propulsion motor, and determine the compaction performance of the machine against the work surface based at least in part on the signal from the force sensor and the propulsion power applied to the second propulsion motor.

19. The machine of claim 16, wherein the compaction performance of the machine against the work surface is not determined based on the power applied by the first propulsion motor to the first propulsion device.

20. The machine of claim 16, wherein the compaction performance of the machine includes at least one of a change in a density of the work surface in response to the rolling engagement of the machine against the work surface, a change in a vertical height of the work surface in response to the rolling engagement of the machine against the work surface, and a change in a stiffness of the work surface in response to the rolling engagement of the machine against the work surface.

* * * * *